United States Patent [19]

Saville et al.

[11] Patent Number: 4,722,483

[45] Date of Patent: Feb. 2, 1988

[54] APPARATUS AND METHOD FOR FRAGMENTING SLAG

[75] Inventors: James Saville, Anniston; Robert L. Cavender, Weaver, both of Ala.

[73] Assignee: Texasgulf Minerals and Metals, Inc., Stamford, Conn.

[21] Appl. No.: 896,659

[22] Filed: Aug. 14, 1986

[51] Int. Cl.[4] ..... B02C 19/12; F27D 3/14

[52] U.S. Cl. ..... 241/23; 241/67; 241/283; 266/137

[58] Field of Search ..... 266/137; 241/23, 24, 241/64, 65, 283, 29, 152 R, 67

[56] References Cited

U.S. PATENT DOCUMENTS 3,417,930 12/1968 Brumagin et al. ..... 241/64

4,522,377 6/1985 Degner ..... 266/137 X

*Primary Examiner*—Mark Rosenbaum

[57] ABSTRACT

Apparatus and method for handling molten slag, in which the slag is delivered from a furnace to a cooling conveyor by a reciprocating spout, driven in a horizontal plane to provide a stream of molten slag in a substantially sinusoidal pattern to the conveyor. The conveyor is sloped to provide gravity flow from an input end to an output end, and vibration is imparted to the conveyor for separating the molten stream of slag into pieces of slag and for propelling slag from the input end toward the output end. Cooling is provided by a water jacket around the sides and bottom of the conveyor, sufficient substantially to solidify the pieces of slag before they reach the output end. Further cooling may be provided by a spray bar, positioned above the conveyor, which provides a stream of cooling water to the surface of the slag. A water bath is disposed to receive pieces of slag dispensed from the output end of the conveyor, further cooling the slag to about 200 degrees Centigrade. Pieces of slag are then received into a screw conveyor, which simultaneously conveys the slag for further processing and reduces the size of individual pieces. A divider may be positioned within the conveyor to assist the vibratory means in separating the molten stream of slag into pieces of slag, suitable for handling.

18 Claims, 5 Drawing Figures

APPARATUS AND METHOD FOR FRAGMENTING SLAG

BACKGROUND OF THE INVENTION

This invention pertains to the art of treating the by-products of metal processing, and more particularly, to the field of processing slag derived from a metal purification process involving molten metal.

As is well-known, many processes for the purification of metals involve melting a base material (such as ore, or scrap) in a furnace. The resulting liquid separates into layers according to density, generally with the desired metal at the bottom of the furnace, and with a layer of various impurities floating at the surface. Such impurities primarily consist of oxides, generally oxides of the primary metal, referred to as "slag" or "dross." Of course, processes involving mattes function in identical fashion; it should be understood that mattes are encompassed by the term "metal" as used herein.

In many instances, slag can be a valuable commercial product in its own right, as, for example, aggregate in making concrete. Processing slag to obtain the material in a usable form, however, poses problems. Traditionally, slag is tapped from the furnace and poured into a mold to cool. Of course, the molten slag is extremely hot and requires some time to cool, requiring the allocation of plant space, and when cooled, such blocks are bulky and heavy, further requiring expensive crushing and handling equipment.

One solution offered by the art to solve such problems is found in U.S. Pat. No. 3,417,930, issued to Brumagin. The apparatus disclosed there includes a tray-like conveyor, cooled by a water jacket and coupled to motors that impart vibration to the tray. Molten slag is poured onto one end of the tray, where it begins to solidify. The tray slopes slightly downward from the input end, and the vibration of the tray causes the slag to move down the conveyor. The apparatus is sized such that the slag is substantially solid by the time it reaches the end of the conveyor.

It has been found, however, that this apparatus produces slag in pieces that continue to require special handling due to their size. It would therefore be advantageous to offer an apparatus for handling molten slag that would produce small, easily processed pieces of cooled slag.

SUMMARY OF THE INVENTION

It is an object of the present invention to provide an apparatus that receives molten slag and fragments the same into relatively small, solidified pieces.

This and other objects are achieved in the present invention. Generally, apparatus according to the invention includes reciprocating spout means for receiving a molten stream of slag from a furnace and delivering same in a substantially sinusoidal pattern to a first conveyor means, which has input and output ends, side walls, and a bottom surface disposed to receive slag from the spout means. A means for imparting vibration to the first conveyor is coupled to the same, and the resulting vibration separates the stream of slag into discrete pieces and causes the pieces of slag to move from the input end to the output end of the conveyor. The first conveyor also has cooling means for extracting heat from the slag during conveyance, so that the slag is solidified before reaching the output end of the conveyor. The apparatus further may include a water bath, disposed to receive slag from the output end of the conveyor, and a second conveyor for removing slag from the water bath and for reducing the size of individual pieces of slag.

In a preferred embodiment, a stream of molten slag flows from a furnace by means of a reciprocating spout, pivoted at the furnace wall and driven in reciprocal horizontal motion. The spout pours molten slag in a substantially sinusoidal pattern onto the receiving end of a tray-like cooling conveyor, which includes a cooling means. The cooling means may be a jacket around the sides and bottom of the tray, through which a cooling medium, such as water, is circulated. A means for imparting vibration, such as a motor driving an unbalanced vibrator, is coupled to the tray, for separating the stream of slag into pieces and for causing the pieces of slag to move down the tray. Such pieces continue down the tray, solidifying before reaching the output end of same. A water bath is positioned to receive the pieces of slag at the end of the tray, such that the slag is immediately cooled to a temperature suitable for handling. A screw conveyor extends into the water bath and conveys pieces of slag to a suitable receiving means, further reducing the size of the pieces as it does so. In an alternate embodiment, the still-molten stream of slag makes contact with an upstanding divider, positioned within the tray, which assists in breaking the stream into a succession of pieces.

DETAILED DESCRIPTION OF A PREFERRED EMBODIMENT

Figure 1:
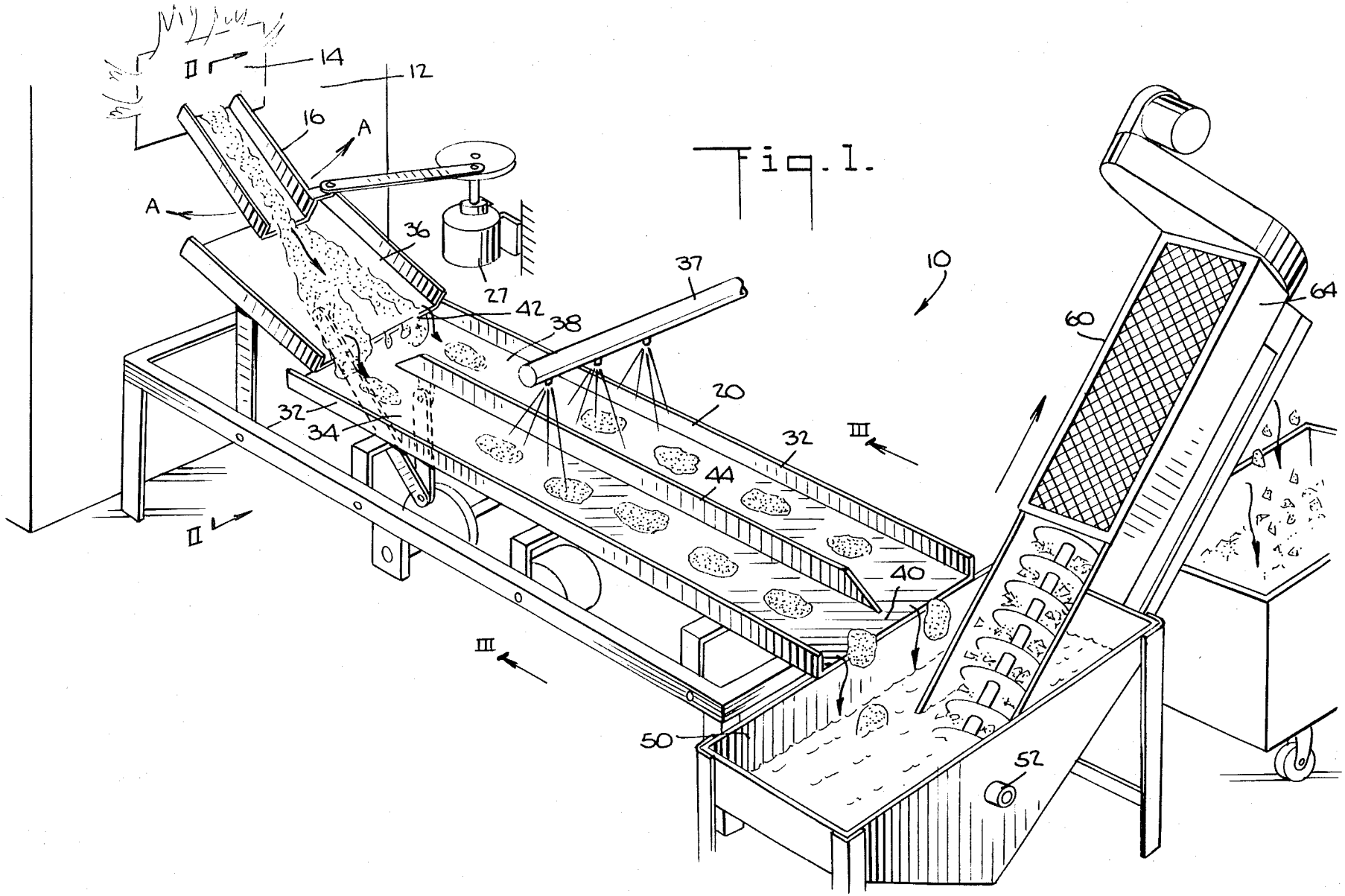
FIG. 1 is a pictorial schematic representation of an embodiment of the invention.
Figure 2:
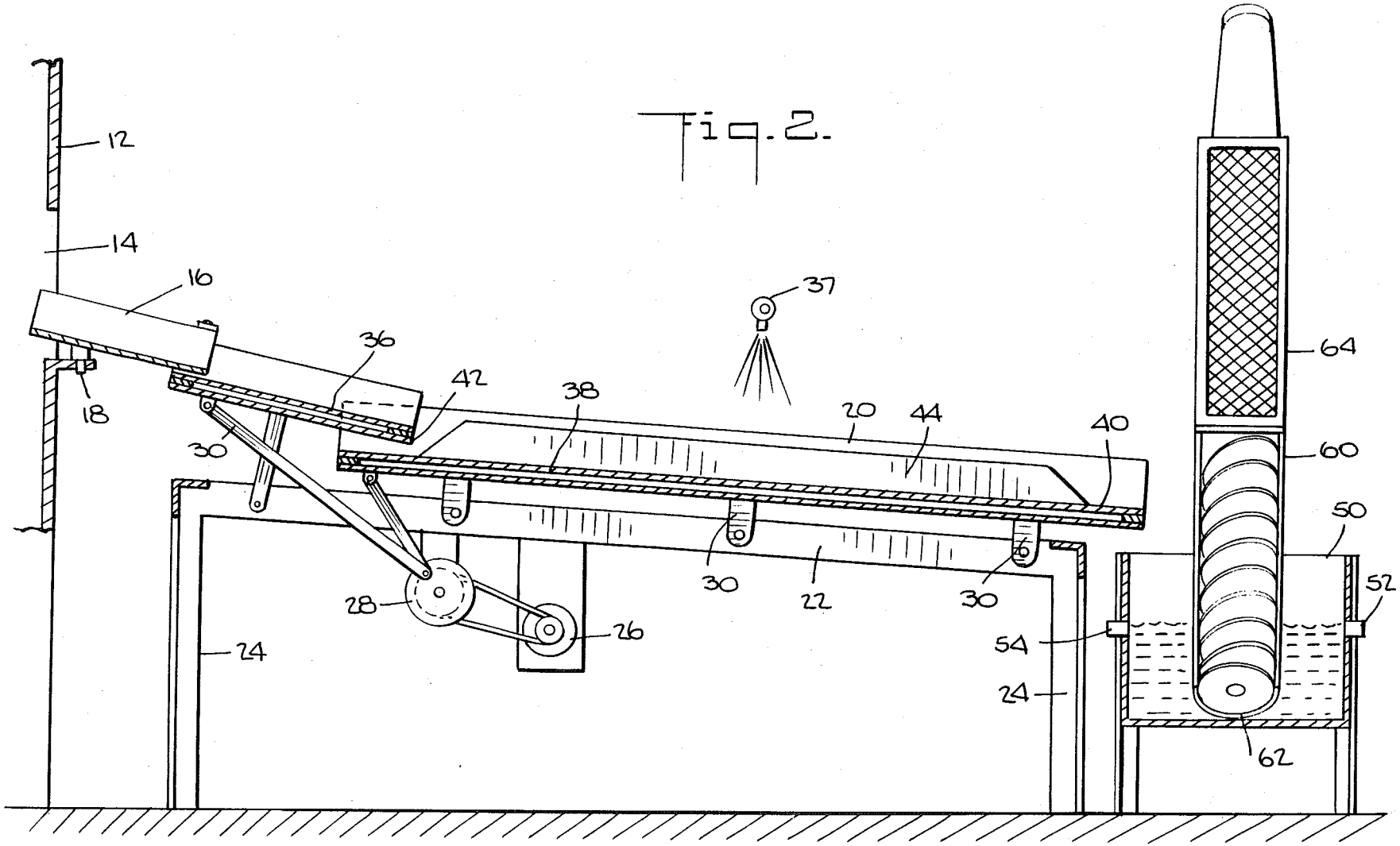
FIG. 2 is a cross-sectional view, taken on plane II—II of FIG. 1.

An embodiment 10 of the present invention is shown in FIGS. 1 and 2. A furnace 12 may be employed, for example, to purify a metal from a base material, which could be ore or scrap material. The particular metal is not important to the invention, as a number of metal purification processes involve melting a base material in a furnace and allowing the resulting liquid to separate according to density. Purified metal can then be extracted by tapping the furnace at a level appropriate to the location of the metal. Generally, the desired metal is the most dense substance in the furnace and settles to the bottom. A combination of impurities, termed "slag" or "dross", usually comprising oxides of the primary metal, floats on the surface of the metal. In a preferred form, the furnace 12 is employed to separate platinum group metals from an ore or scrap material, and the slag primarily includes aluminum oxides. Those in the art will understand, however, that the invention can be employed in a number of metal-purification processes, all of which produce slag. Removal and processing of this slag is the focus of the present invention.

Figure 4:
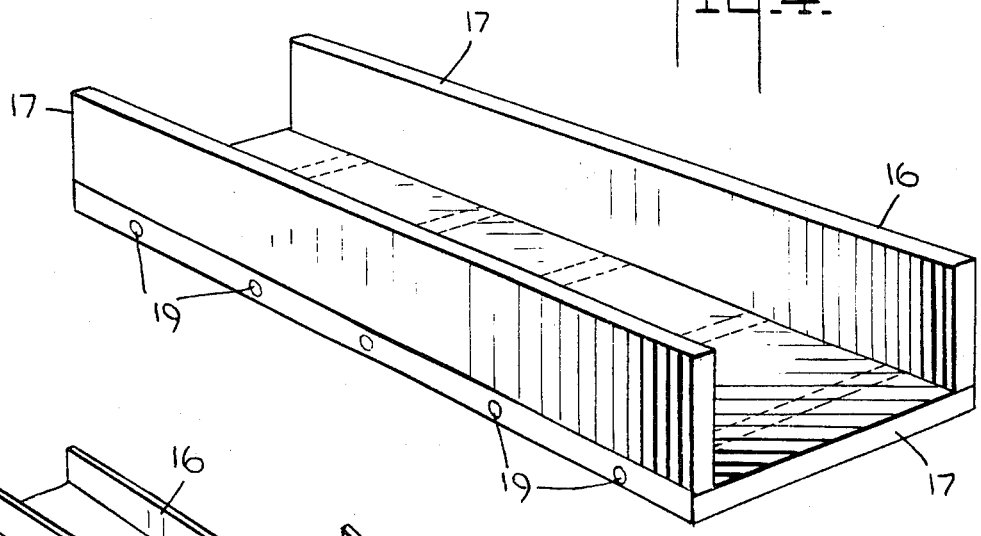
FIG. 4 is a pictorial representation of the reciprocating spout of the embodiment shown in FIG. 1.

An aperture 14 is provided in the side of the furnace, located at a height suitable for slag removal. A spout 16 extends into this aperture, positioned to receive a flow of slag when the total height of molten liquid in the furnace reaches a selected level. Preferably, this spout takes the form of a channel, having a bottom surface 15 and side walls 17, as can be seen more clearly in FIG. 4. Of course, the slag emerging from the furnace is at a highly elevated temperature, which may be about 1000°–1500° C. To prevent overheating as a result of such temperatures, the spout is provided with cooling means, in the form of coolant channels 19, connected to suitable coolant supply means (not shown). It has been found effective to employ highly heat-conductive material, such as copper, for the spout.

The spout supplies slag to a cooling conveyor 20. Unlike the teaching of the prior art, however, the spout does not merely convey the slag, but it also distributes the slag laterally on the conveyor. The spout is mounted on the furnace on a pivot pin 18, allowing the end of the spout disposed toward the conveyor to move in a horizontal plane from one side of the conveyor to the other, as shown by arrows A. Any suitable means can be employed to produce such motion, and it is preferred to employ a motor 21, turning an eccentric wheel 23, which in turn drives a connecting rod 25, attached at its respective ends to the wheel and to the spout. Of course, those in the art will understand that a variety of alternatives to this arrangement could be employed.

The cooling conveyor is mounted on a suitable means, such as table 22, supported by support means such as legs 24. The conveyor also includes a means for imparting vibration, thus inducing the slag to move from one end of the conveyor to the other, as disclosed in U.S. Pat. No. 3,417,930, discussed above. Such means can include a motor 26 driving a rotary unbalanced mechanical vibrator 28, which may be coupled to the conveyor by mounts 30, including flexible means, such as springs.

The reciprocating spout and the vibratory conveyor cooperate to produce unexpected results. Because the stream of slag is deposited upon a sloped, vibrating surface, it moves longitudinally down the conveyor. Simultaneously, the mouth end of the spout is moving laterally, as discussed. Therefore, the stream of molten slag is deposited in the form of a substantially sinusoidal pattern. When this pattern is compared to the results achieved by a stationary spout, it is clear that the stream of the present invention is spread over a wider area on the conveyor surface, and is therefore thinner than the counterpart stream found in prior art devices. As the slag cools and begins to solidify, the vibratory forces acting upon the slag causes the the stream to separate into discrete pieces, markedly smaller than the output observed from any prior art apparatus.

The conveyor has a tray-like form, with a bottom 32 and sides 34, and includes two sections. A receiving section 36 is disposed at the input end of the conveyor, located adjacent the furnace, and a cooling section 38 extends from the receiving section to the output end 40, located at the opposite end of the conveyor. Both sections are sloped downward with respect to the furnace, but the receiving section has a steeper slope. For example, the receiving section can be sloped at angles in the range 2–40 degrees, and preferably about 10 degrees, compared to a typical slope of about 5 degrees for the cooling section. A vertical step 42 separates the two sections.

In an alternate embodiment of the invention, the cooling section is separated into two channels by a divider 44. This element is a vertically-extending member located in the center of the conveyor, of a height in excess of that expected for the pieces of slag, preferably about 3 inches. One end of the divider terminates at a point downslope of the input end of the conveyor, at a point chosen to allow slag to begin cooling slightly before impacting the divider. The divider may be welded or otherwise suitably fixed in position.

Although the embodiment shown in FIGS. 1 and 2 employs a single divider, a plurality of dividers could be utilized to break slag into smaller pieces during the conveyance. Such apparatus would be more difficult and costly to produce, of course, and it has been found that at most, a single divider serves to accomplish the goal of size reduction.

Figure 5:
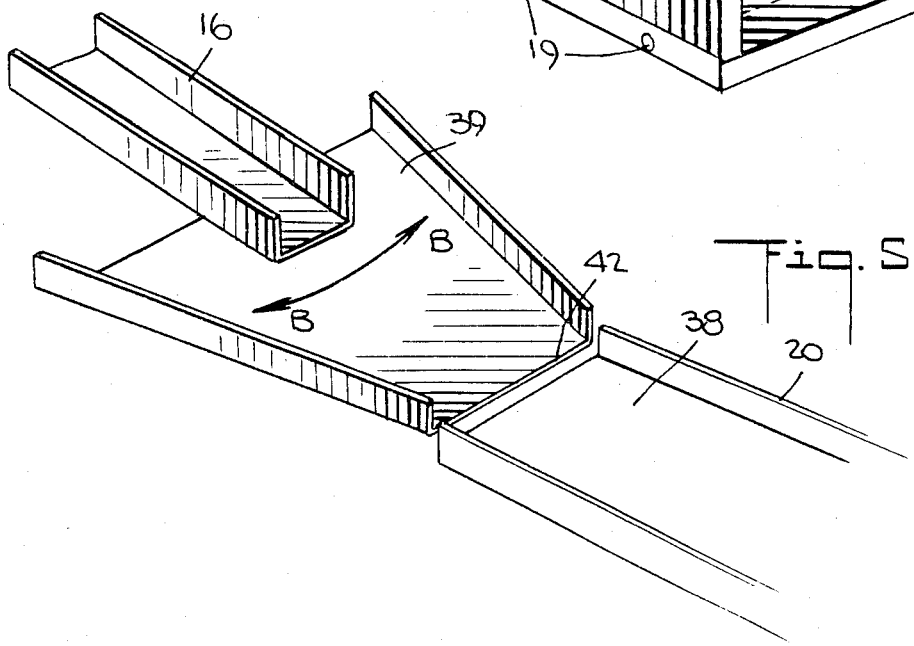
FIG. 5 is a pictorial representation of an alternative embodiment of the invention.

As shown in FIG. 5, further advantages can be achieved by fabricating the receiving end of the conveyor in a fan-shaped configuration 39, with its wide end adjacent the furnace. The increased width of the receiving end input portion requires that the spout travel a wider arc, shown by arrow B. Given that the flow rate remains constant, it follows that the substantially sinusoidal pattern of molten slag is deposited over a wider area, and therefore will be thinner that the stream deposited in the embodiment discussed above. Such decreased thickness allows the molten slag to solidify more rapidly, and that process further amplifies the effectiveness of the separating action of the vibratory mechanism. Therefore, the pieces of slag that result from this apparatus will be smaller and easier to handle than the output from the straight-side design. It has been found helpful to increase the slope of the receiving end 39 to about 15 degrees to facilitate rapid flow across the relatively wider surface of the fan-shaped portion.

To further assist the solidification of the slag, a spray bar 37 may be provided, positioned over the receiving section of the cooling conveyor. The bottom surface of the slag undergoes relatively effective conduction cooling from the conveyor, but the slag's top surface is limited to convection cooling from the ambient air, a relatively inefficient process. The spray bar promotes cooling by providing a spray of water droplets that make contact with the slag and immediately boil off, extracting heat from the slag as they do so. The spray bar offers the added advantage of increased lubrication of the conveyor surface (and thus more rapid movement of the slag), as the presence of moisture on the bottom surface of the conveyor decreases the friction between that surface and the slag.

Figure 3:
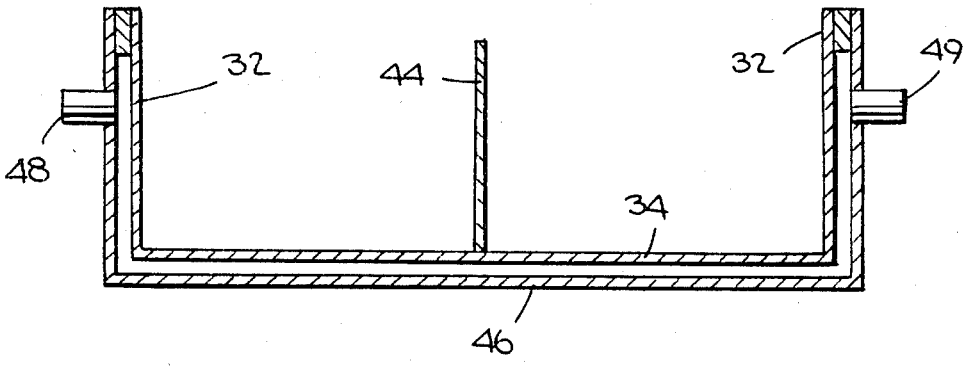
FIG. 3 is a cross-sectional view, taken on the plane III—III of FIG. 1.

A primary function of the conveyor is cooling the slag, and to this end the conveyor is provided a cooling means, preferably a coolant jacket 46, extending around the sides and bottom of the conveyor, as shown in FIG. 3. Any convenient cooling medium can be employed to effect such cooling, but it has been found effective to use water to perform this function. Water can be circulated through inlet ducts 48 and outlet ducts 49, driven by appropriate pumping means (not shown). Those in the art will appreciate the requirement to size the conveyor and its cooling means such that the slag is substantially solidified by the time it reaches the output end of the conveyor.

It is possible to provide a conveyor of sufficient length to cool the slag completely before it reaches the output end. It has been found, however, that such an arrangement is highly wasteful of plant space. A more efficient system involves a combination of a cooling conveyor and a water bath 50, disposed at the output end of the conveyor to receive pieces of slag emerging from the output end of same. Such pieces of slag fall from the conveyor into the bath, in which water is circulated by feed duct 52 and return duct 54. The water further cools the slag rapidly to a handling temperature, such as about 200 degrees C. Preferably, the water bath is in the form of a trough.

A screw conveyor 60 has an input end 62 extending into the water bath at the location where pieces of slag fall into the bath. This conveyor is enclosed on at least three sides (both sides and bottom) by housing 64. This conveyor continuously receives pieces of slag from the bath and moves them upward. The helical screw also exerts force upon the pieces of slag, breaking them into still smaller pieces. This conveyor can feed into any suitable handling apparatus for further processing, such as bagging, crushing, etc.

The water feed rate to the trough is controlled, as will be understood by those in the art, to cool the slag to a temperature that will facilitate handling and drying. It has been found that if the feed rate is increased to the point that the slag is cooled to a level below the boiling point of water, the slag will not dry rapidly within the screw conveyor. Constituents of the slag can be highly corrosive, and when combined with water such substances can damage the screw conveyor.

The invention operates to fragment slag into small, easily-handled pieces in the following manner. Slag accumulates at the surface of the molten metal within the furnace 12 until the slag level reaches a point at which slag flows out of the furnace through spout 16. Driven by motor 21, which operates though connecting rod 25, the spout reciprocates in a horizontal plane across the input end of a cooling conveyor 20. Slag is deposited across the receiving end 36 of the conveyor in a continuous, substantially sinusoidal pattern. The relatively steep slope of this portion of the conveyor causes the slag stream to flow relatively rapidly, continuing down the step 42 and pooling slightly in the initial portion of cooling section 38. The vibratory motion of the conveyor (imparted by the motor 26, driving rotary unbalanced mechanical vibrator 28) impels the slag down the conveyor. As the slag cools and solidifies, the force imparted by the vibratory mechanism separates the stream of slag into pieces, which are suitable for handling. In an alternate embodiment of the invention, the separating action of the vibratory mechanism may be supplemented by an upstanding divider 44, positioned within the conveyor.

The conveyor includes cooling means, such as a coolant jacket 46 extending around the bottom and sides of the conveyor, to extract heat from the slag as it moves down the conveyor. A spray bar 37 may also be provided, to facilitate the cooling of the slag's surface and to provide additional lubrication to the conveyor surface. The apparatus is sized such that the slag is substantially solidified by the time it traverses the conveyor. The pieces of slag retain a considerable amount of heat at this point, however; to enable immediate handling of the slag, a water bath may be positioned at the output end of the conveyor, so that pieces of slag fall into same. Water is circulated through this bath, so that remaining heat is extracted from the pieces in a short amount of time. Screw conveyor 60 extends into the water bath and picks up pieces of slag for conveyance to a receiving means, such as a truck or the like. While being moved upward by this conveyor, the slag is further reduced in size by the action of the helical screw.

Those in the art will understand that alterations and modifications to the embodiment shown can be made within the scope of the invention. For example, it would be possible to adapt the invention to other metal-purification processes, or to provide alternate means for reciprocating the spout. These and other modifications may be made within the spirit of the present invention, which is defined solely by the claims appended hereto.

We claim:

1. Apparatus for fragmenting slag, comprising:

reciprocating spout means, for delivering a substantially continuous stream of molten slag from a furnace in a substantially sinusoidal pattern; and a first conveyor means, having input and output ends and having side walls and a bottom surface sloped at an angle from the horizontal, for inducing a gravitational acceleration from said input end toward said output end, and being disposed to receive slag from said spout means;

said first conveyor means including means for imparting vibration to said first conveyor means, for separating the molten stream of slag into pieces of slag during conveyance and for causing said slag to move from said input end to said output end; and cooling means for extracting heat from the slag, so that the slag is substantially solidified before reaching said output end.

2. The apparatus of claim 1, further comprising water bath means, disposed to receive slag from said output end; and second conveyor means, for removing pieces of slag from said bath means and reducing the size of individual pieces of slag.

3. The apparatus of claim 1, wherein said first conveyor means further includes divider means, disposed within said first conveyor for assisting in separating the molten stream of slag into pieces of slag during conveyance.

4. The apparatus of claim 3, wherein said divider means defines flow channels between said side walls of said cooling conveyor means.

5. Apparatus for fragmenting slag, comprising:

cooling conveyor means for cooling molten slag to a substantially solidified condition, having an input end and an output end, with a receiving portion disposed toward said input end and a cooling portion disposed toward said output end, said receiving portion being sloped at a greater angle to the horizontal than the slope of said cooling portion;

spout means for delivering a stream of molten slag in a substantially continuous, substantially sinusoidal pattern to said receiving portion of said cooling conveyor; and vibratory means for imparting vibration to said cooling conveyor means, thereby separating the molten stream of slag into pieces of slag and inducing said pieces of slag to move from said input end toward said output end.

6. The apparatus of claim 5, wherein said cooling conveyor means further includes divider means disposed within said cooling conveyor means, for assisting said vibratory means in separating said molten stream of slag into discrete pieces.

7. The apparatus of claim 6, further comprising final processing means for further cooling and fragmenting the slag, including water bath means, disposed to receive pieces of slag from said output end of said cooling conveyor, the temperature of said water bath being maintained at a sufficient level to cool said slag to about 200 degrees Centigrade: and screw conveyor means, disposed to receive pieces of slag within said water bath means, for removing pieces of slag from said bath means and reducing the size of individual pieces of slag.

8. Apparatus for fragmenting slag, comprising:

reciprocating spout means, for delivering a substantially continuous stream of molten slag from a furnace in a substantially sinusoidal pattern, said spout means being mounted for reciprocating pivotal motion in a substantially horizontal plane; and conveyor means, having input and output ends and having side walls and a bottom surface sloped at an angle from the horizontal for inducing a gravitational acceleration from said input end toward said output end, and being disposed to receive slag from said spout means;

said conveyor means including means for imparting vibration to said conveyor means, for separating the molten stream of slag into pieces of slag and for causing said slag to move from said input end to said output end;

cooling means for extracting heat from the slag, so that the slag is substantially solidified before reaching said output end; and spray bar means, disposed above said conveyor, for providing a coolant spray to the surface of the slag.

9. The apparatus of claim 8, wherein said conveyor means further includes divider means, disposed within said conveyor for assisting said vibration-imparting means in separating the molten stream of slag into pieces of slag.

10. The apparatus of claim 8, further comprising final processing means for further cooling and fragmenting the slag, including water bath means, disposed to receive pieces of slag from said conveyor, for further cooling said pieces of slag to about 200 degrees Centigrade; and screw conveyor means, disposed to receive pieces of slag within said water bath means, for removing pieces of slag from said bath means and reducing the size of said pieces of slag.

11. In an apparatus for fragmenting slag, the apparatus including a cooling conveyor means for receiving slag from a furnace, means for cooling same to a substantially solidified condition, and means for dispensing same, the improvement wherein slag is conveyed from the furnace to the cooling conveyor by a spout means, mounted for reciprocating motion in a horizontal plane, for depositing a substantially continuous molten stream of slag on the cooling conveyor in a substantially sinusoidal pattern; and the cooling conveyor means includes vibratory means, for separating the molten stream of slag into pieces of slag during conveyance.

12. Apparatus for fragmenting slag, comprising:

a first conveyor means for conveying slag from an input end to an output end and cooling the slag to a substantially solidified condition, having side walls and a bottom surface, the bottom surface being sloped at an angle from the horizontal for inducing a gravitational acceleration from said input end toward said output end, including a receiving portion disposed toward said input end for receiving a stream of molten slag, and a cooling portion disposed toward said output end for providing substantially solidified slag, said receiving portion being sloped at a greater angle to the horizontal than the slope of said cooling portion;

cooling means for extracting heat from the slag, so that the slag is substantially solidified before reaching said output end; and means for imparting vibration to said first conveyor, for separating the molten stream of slag into pieces of slag and for causing said slag to move from said input end to said output end;

spout means, driven in reciprocating motion in a horizontal plane, for delivering a continuous stream of molten slag from a furnace to said receiving portion of said first conveyor in a substantially sinusoidal pattern;

water bath means for cooling said pieces of slag to a temperature of about 200 degrees Centigrade, disposed to receive slag from said output end of said first conveyor; and second conveyor means, for removing pieces of slag from said water bath means and reducing the size of individual pieces of slag.

13. The apparatus of claim 12, wherein said first conveyor means further includes divider means, disposed within said first conveyor for assisting said vibration-imparting means in separating the molten stream of slag into pieces of slag during conveyance, said divider means defining at least two flow channels within said first conveyor.

14. The apparatus of claim 13, wherein said cooling means further includes spray bar means, disposed above said first conveyor, for providing a coolant spray to the surface of the slag.

15. The apparatus of claim 12, wherein said cooling means further includes spray bar means, disposed above said first conveyor, for providing a coolant spray to the surface of the slag.

16. A method for cooling and handling molten slag, comprising the steps of:

pouring a continuous stream of molten slag from a furnace to a cooling conveyor means in a substantially sinusoidal pattern;

separating said stream of slag into discrete pieces of slag; and extracting sufficient heat from said pieces of slag substantially to solidify said pieces of slag.

17. The method of claim 16, further comprising the steps of:

further cooling said pieces of slag in a water bath means, to a temperature of about 200 degrees Centigrade; and reducing the size of said pieces of slag.

18. A method for cooling and handling molten slag, comprising the steps of:

pouring a stream of molten slag from a furnace to a cooling conveyor means in a substantially continuous, sinusoidal pattern;

separating said stream of slag into discrete pieces of slag by a combination of vibratory motion and impact against a longitudinal divider means positioned in said cooling conveyor means;

extracting sufficient heat from said pieces of slag substantially to solidify said pieces of slag further cooling said pieces of slag in a water bath means, to a temperature of about 200 degrees Centigrade; and reducing the size of said pieces of slag.

* * * * *